US011549276B2

(12) United States Patent
Wares

(10) Patent No.: US 11,549,276 B2
(45) **Date of Patent: *Jan. 10, 2023**

(54) FABRIC CHILDREN'S WADING POOL AND METHOD OF USE

(71) Applicant: Larry Wares, San Clemente, CA (US)

(72) Inventor: Larry Wares, San Clemente, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/950,794

(22) Filed: Nov. 17, 2020

(65) Prior Publication Data

US 2021/0062526 A1 Mar. 4, 2021

Related U.S. Application Data

(63) Continuation of application No. 16/457,660, filed on Jun. 28, 2019, now Pat. No. 10,837,188.

(51) Int. Cl.

| | |
|---|---|
| ***E04H 4/00*** | (2006.01) |
| ***E02D 27/38*** | (2006.01) |
| ***E04H 4/14*** | (2006.01) |

(52) U.S. Cl.

CPC ..... *E04H 4/0018* (2013.01); *E02D 27/38* (2013.01); *E04H 2004/146* (2013.01)

(58) Field of Classification Search

CPC ..... E04H 4/0018; E02D 27/38
USPC ..... 4/506
See application file for complete search history.

(56) References Cited

U.S. PATENT DOCUMENTS

| | | | |
|---|---|---|---|
| 4,597,113 | A | 7/1986 | Eymard |
| 4,860,914 | A | 8/1989 | Derni et al. |
| 4,935,970 | A | 6/1990 | Aristone |
| 5,881,402 | A | 3/1999 | Devino et al. |
| 6,408,454 | B1 | 6/2002 | Hyde |
| 6,684,429 | B1 | 2/2004 | Deering |

(Continued)

FOREIGN PATENT DOCUMENTS

EP 1312731 A2 5/2003

OTHER PUBLICATIONS

Intex: kiddie pools: Target, http://www.target.com/c/kiddie-pools-swimming-water-slides/intex/-/N-5xt5cZ5xwyn—2 pages.

*Primary Examiner* — Christine J Skubinna
(74) *Attorney, Agent, or Firm* — Lapple Ubell IP Law, LLP; Matthew C. Lapple

(57) ABSTRACT

A foldable, portable fabric children's wading pool for installation in the ground and which has improved stability characteristics is provided. The pool includes a base region with a generally circular sheet of water-resistant woven fabric with a thread denier of between 400 denier and 600 denier, a stabilizer region comprising one or more sections of woven fabric with a thread denier of between 200 denier and 400 denier, where the stabilizer region is affixed to the outer edge of the base region, and with a number of sand anchors affixed to the stabilizer region. The pool is set up by digging a hole in the ground and forming berms along the edges of the hole. Then, the pool is unfolded and positioned such that the waterproof fabric base is in the hole, and the sand anchor section extends downwardly and outwardly from the edge of the sand berm. Then, a weighting material is loaded onto the sand anchor section and the pool is filled with water, preferably using the waterproof bag that also serves as a storage and transport bag for the pool when folded.

17 Claims, 10 Drawing Sheets

(56) References Cited

U.S. PATENT DOCUMENTS

| | | | | |
|---|---|---|---|---|
| 6,886,189 | B1 | 5/2005 | Wu | |
| 7,308,989 | B2 | 12/2007 | Zheng | |
| D587,332 | S * | 2/2009 | Queli | D21/815 |
| D757,875 | S | 5/2016 | Wares | |
| 9,518,399 | B2 * | 12/2016 | Wares | E04H 4/0018 |
| D790,646 | S | 6/2017 | Wares | |
| 9,963,894 | B2 | 5/2018 | Wares | |
| 2003/0019024 | A1 | 1/2003 | Tompkins | |
| 2004/0058603 | A1 * | 3/2004 | Hayes | B32B 27/304 442/286 |
| 2004/0140306 | A1 | 7/2004 | Arias et al. | |
| 2007/0248414 | A1 | 10/2007 | Fratianni | |
| 2010/0294759 | A1 | 11/2010 | Yu | |
| 2011/0131719 | A1 | 6/2011 | Rudenberg | |
| 2012/0023655 | A1 * | 2/2012 | Junquet | E04H 4/0018 4/513 |
| 2014/0020169 | A1 | 1/2014 | Capps | |
| 2014/0137320 | A1 * | 5/2014 | Taylor | E04H 4/0018 4/506 |

* cited by examiner

FABRIC CHILDREN'S WADING POOL AND METHOD OF USE

CROSS-REFERENCE TO RELATED APPLICATIONS

This application is a continuation of U.S. patent application Ser. No. 16/457,660; filed on Jun. 28, 2019, and issued as U.S. Pat. No 10,837,188 on Nov. 17, 2020, which is incorporated by reference herein in its entirety.

BACKGROUND

Going to the beach, either at the ocean or at a lake, is a common and beloved pastime for families. However, trips to the beach often present challenges to families with young children, particularly with respect to the safety and comfort of the children. Specifically, young children who have not yet learned to swim, or who are weak swimmers, should generally not be allowed to play in waves or rough surf. Further, for much of the year, although air temperatures may be pleasant, water temperatures remain too cold for young children. This is particularly true along the Pacific Coast of California. Nevertheless, few children want to go to the beach and not play in the water. As such, it is popular to bring a portable swimming pool to the beach, fill the pool with ocean or fresh water, and permit the child or children to bathe or swim therein. These portable pools are well known in the prior art and typically are inflatable or molded from plastic.

Such prior art portable pools are cumbersome, take up significant room in the family's vehicle, and tend to be unstable in the sand. Therefore, it would be advantageous to provide a portable wading pool for use at the beach which is easily transportable and stable when in place at the beach.

Some prior art approaches to solving the problems of transportability and stability have focused on positioning a rubber or fabric pool in a hole dug into the sand. However, each of these prior art approaches suffer from various instability and inconvenience problems. U.S. Pat. No. 5,881,402, entitled, "Portable In-Ground Pool," issued to Devino on Mar. 16, 1999, discusses a portable pool for beach use which employs an inflatable circumferential ledge which is secured into the sand utilizing stakes. Several disadvantages of this prior art pool are the fact that it must be inconveniently staked down and inflated to try to achieve stability. However, it is likely still unstable and prone to deformation of the pool and collapse of the sand sidewalls, or to having the stakes pulled out of the sand when the pool is filed and/or children enter and exit it, due to the weight of water and children on the sides and bottom of the pool, all of which could lead to failure of the pool fabric, leakage of water, causing falls of children entering or exiting the pool, and causing undue amounts of sand to fall into the pool.

Published Patent Application No. US 2007/0248414 A1, entitled, "Method and Apparatus for Making a Pool," was filed by Ralph Fratianni on Apr. 20, 2007, and was published on Oct. 25, 2007. This published application discusses an apparatus for forming a pool including a panel of waterproof material supportable by a surface of a concaved area of sand and at least one sleeve or pouch coupled to or formed in an outer edge of the material, the at least one sleeve or pouch capable of holding a weighting substance and preventing an entire outer edge of the material from being relocated by the wind. Disadvantages of this prior art pool include instability and a tendency to have deformation of the pool and collapse of the sand sidewalls, when the pool is filed and/or children enter and exit it, due to the weight of water and children on the sides and bottom of the pool, all of which could lead to failure of the pool fabric, leakage of water, causing falls of children entering or exiting the pool, and causing undue amounts of sand to fall into the pool. Moreover, the described sleeve or pouch would appear to be difficult to load and unload with weighting material that is readily available at the beach, namely sand.

Published Patent Application No. US 2012/0023655 A1, entitled, "Portable Swimming Pool for Beach Use," was filed by Jeffrey Junquet on Jul. 26, 2011, and was published on Feb. 2, 2012. This published patent application discusses a portable swimming pool for use at the beach formed from vinyl or other flexible waterproof material comprising a circular base and a side wall that extends upward from the base and tapers outward as it extends up. To use it, a user digs a hole and unfolds the pool into the hole. The Junquet portable swimming pool, discussed, also includes a sand apron extending outwardly from the edge of the side wall, which can be laid out on the surface of the sand next to the hole, and then covered with sand, which allegedly provides stability. Disadvantages of this prior art pool include instability in the interface between the pool and the sand, a tendency to have deformation of the pool and collapse of the sand sidewalls, when the pool is filed and/or children enter and exit it, due to the weight of water and children on the sides and bottom of the pool, all of which could lead to failure of the pool fabric, leakage of water, causing falls of children entering or exiting the pool, and, due to the sand apron lying flat on the surface of the sand—and then be covered with a layer of sand—having undue amounts of sand to fall into the pool as children enter and exit it.

U.S. Pat. Nos. 9,518,399 and 9,963,894 discuss prior art fabric wading pools invented by the present Applicant. Further research and investigation by Applicant has revealed drawbacks and problems with the pools disclosed in these patents, related to their ease-of-use, which impact directly upon a parent's willingness to use these patented devices, particularly when faced with an impatient toddler that wants to swim in the pool, or alternatively, run toward the breaking surf. Some parents who tested an embodiment of the device disclosed in the '399 patent found that the oval-shaped hole required by some embodiments of the '399 patent was difficult to accurately dig in the sand and to then mound up the sand berms at the edges of that oval-shaped hole, so that the berms aligned with the fixed sand stabilizers of that patented embodiment. Relatedly, some parents who tested an embodiment of the device disclosed in the '894 patent found that it was difficult to position the moveable sand stabilizers correctly over the top of a sand berm, that children tripped on the moveable sand stabilizers, or simply pulled them off of their Velcro anchor points. Still further, other parents found that using the upwardly projecting foam sand anchors of the embodiment of the '894 patent required what they considered to be an excessive amount of positioning and pouring of sand onto multiple small sand anchors. Based on these inconveniences and usage issues, Applicant sought a simpler and easier-to-use system that still overcome the drawbacks of the other prior art discussed herein.

Further, Applicant has discovered that various prior art, including the Applicant's own prior inventions, have drawbacks resulting from the particular weight, thickness, and material of the fabric used. Materials that are too thick often do not form properly to the sand when water is poured into them, resulting in problems with the ease of use, the ability of the fabric to remain in place and stretch out given the weight placed in the sand anchors, and the ability to large and unsightly wrinkles or folds in the material when the pool is filled with water. Overly thick materials also do not fold or pack well when the pool is prepared for carrying and storage. Moreover, many overly thick materials do not dry quickly, and due to trapped or retained moisture, are at risk for mold and bacterial growth when stored between uses.

On the other hand, Applicant has discovered that materials that are too thin also suffer from drawbacks. Overly thin materials do not stabilize the pool sides and bottom. When a child steps into or stands in the middle pool section, overly thin fabric can compress into the sand, pulling the rest of the fabric toward the spot where the child stepped or stood, thereby displacing the pool limits and deforming the shape of the pool, which reduces stability of the sand at the sides of the pool. Overly thin materials for the center of the pool are also not complementary with the outer material that form the sand anchors.

Further, the Applicant has discovered that, in pools that use a single type and/or thickness of material, it is difficult to achieve a satisfactory balance between the stability of the sand and the water, as described above with respect to other prior art efforts.

Further, use of a single type of material, or a single color of material, does not create an obvious visual separation (for the parent or child) between the water area and the sand anchor area. This lack of visual separation makes set-up of the pool more difficult for the parent, and ingress and egress more difficult for the child.

The Applicant has also discovered that, in pools that use more than one material, were the materials meet, they must complement each other in a way that creates stability in the weight balance between the sand anchors and the water.

Thus, there is a need to be able to have a portable wading pool that is stable, with respect to both wind and shifting sand, is able to easily allow children to climb into and out of the pool, and is easy for parents to set up, while withstanding the rigors of children climbing into and out of the pool when filled with water and not filling with spilled sand.

SUMMARY

The present disclosure addresses and alleviates these problems with prior art. Because various embodiments of the foldable children's wading pool of the present invention exist, this summary is provided for convenience and should be understood not to limit the inventions set forth in the claims.

In a first aspect, a portable fabric wading pool is provided, the pool including a base region made up of a generally circular sheet of woven fabric, where the woven fabric of the base region is a fabric with a thread denier of between 400 denier and 600 denier, where the woven fabric of the base region is water-resistant, where the base region has an outer edge, and a stabilizer region including one or more sections of woven fabric, where the woven fabric of the stabilizer region is a fabric with a thread denier of between 200 denier and 400 denier, where the stabilizer region is affixed to the outer edge of the base region and a plurality of sand anchors are affixed to the stabilizer region.

In an embodiment of the first aspect, each of the plurality of sand anchors is a pocket on the stabilizer region.

In another embodiment of the first aspect, the woven water-resistant fabric of the base region is polyester.

In another embodiment of the first aspect, the woven water-resistant fabric of the base region is 500 denier canopy polyester.

In another embodiment of the first aspect, the woven water-resistant fabric of the base region has a waterproof coating.

In another embodiment of the first aspect, the waterproof coating is polyurethane.

In another embodiment of the first aspect, the woven water-resistant fabric of the base region is 500 denier canopy polyester with a pigment urethane coating.

In another embodiment of the first aspect, the stabilizer region fabric is water permeable.

In another embodiment of the first aspect, the stabilizer region fabric is a 400×300 denier nylon/polyester blend.

In another embodiment of the first aspect, the stabilizer region fabric is a diamond-pattern ripstop fabric.

In another embodiment of the first aspect, the pool has four sand anchors.

In another embodiment of the first aspect, the four sand anchors are oriented as the four corners of a square.

In another embodiment of the first aspect, the woven fabric of the base region and the woven fabric of the stabilizer region are different colors, whereby there is a visual distinction between the base region and the stabilizer region.

In another embodiment of the first aspect, each of the sand anchors can hold between about one gallon and three gallons of sand.

In another embodiment of the first aspect, when the wading pool is deployed, the base region can hold up to 40 gallons of water.

In another embodiment of the first aspect, the diameter of the base section is 60 inches.

In another embodiment of the first aspect, the pool includes a first seam, which is the union between the outer edge of the base region and the stabilizer region, and the first seam is stitched such that a first portion of the base region is under a portion of the stabilizer region.

In another embodiment of the first aspect, the stabilizer section also includes a reinforced edge of stitching to finish and reinforce an outer edge of the stabilizer section.

In another embodiment of the first aspect, there are four sand anchors, positioned at approximately ninety-degree angles, radially, from one another and each of the sand anchors is a pocket affixed to the stabilizer region.

In another embodiment of the first aspect, the stabilizer region includes, for each of the plurality of sand anchors, a sand anchor seam, where each sand anchor seam is a stitched line that is generally aligned along a line between a center point of the generally circular base region and an outer edge of the respective sand anchor, so that a line of force is established between the respective sand anchor and the base region, when the respective sand anchor is filled with a weighting substance and the base region is filled with water.

In another embodiment of the first aspect, where the stabilizer section includes a reinforced edge, where the reinforced edge is stitching to finish and reinforce an outer edge of the stabilizer section, so that a line of force is established between each of the respective sand anchors, when the sand anchors are filled with a weighting substance and the base region is filled with water.

In a second aspect, the wading pool includes a separate fabric bag, into which a user can fold and store the entire wading pool.

In an embodiment of the second aspect, the separate fabric bag is waterproof and may be used to carry water to fill the pool during setup.

BRIEF DESCRIPTION OF THE DRAWINGS

In the descriptions that follow, like parts or steps are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objectives and advantages thereof, will be best understood by reference to the following detailed description of illustrative embodiments when read in conjunction with the accompanying drawings, wherein.

DETAILED DESCRIPTION OF THE PREFERRED EMBODIMENTS

Figure 1:
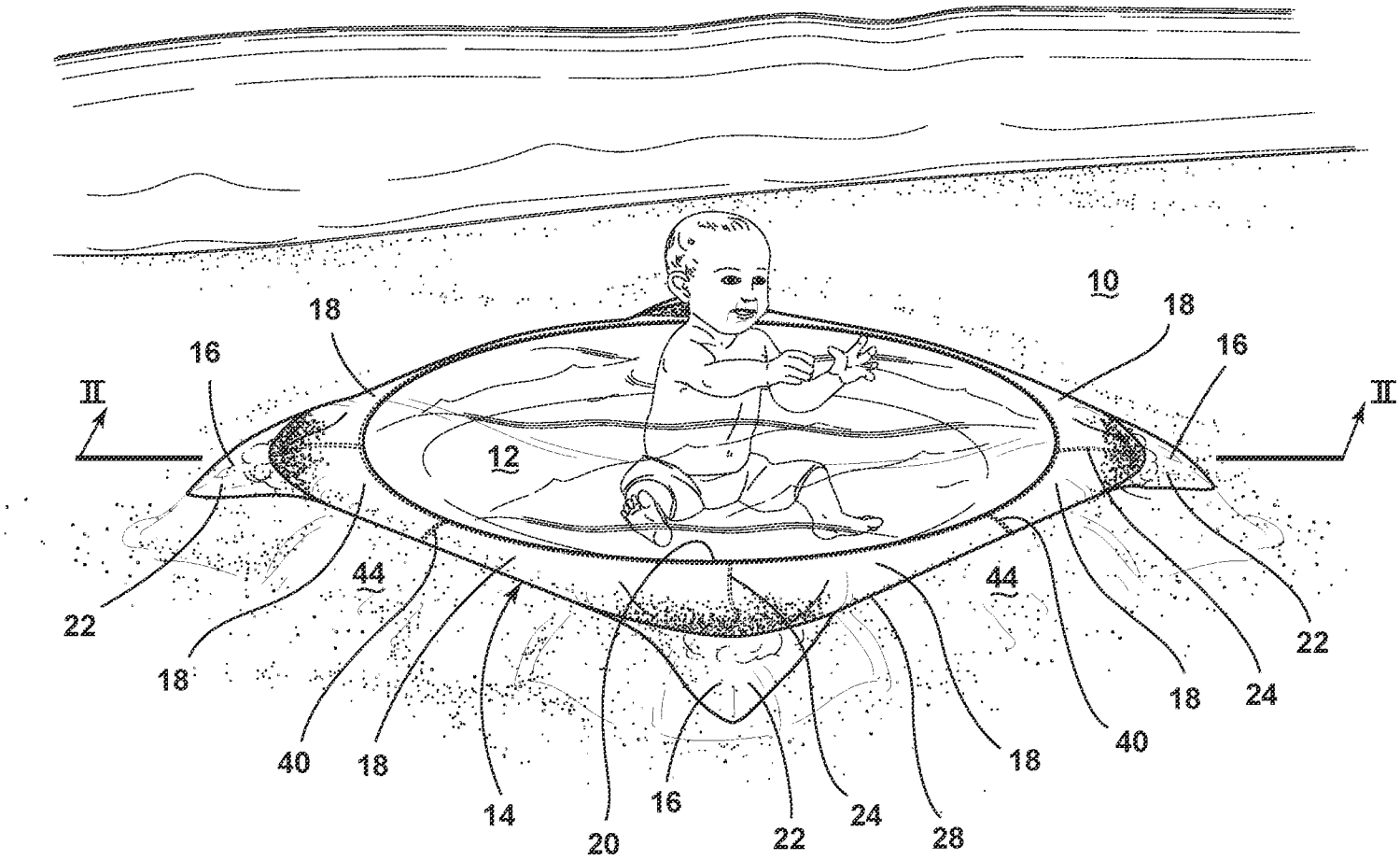
FIG. 1 is a perspective view of an embodiment of a foldable children's wading pool disclosed herein, that is in use at a beach.
Figure 2:
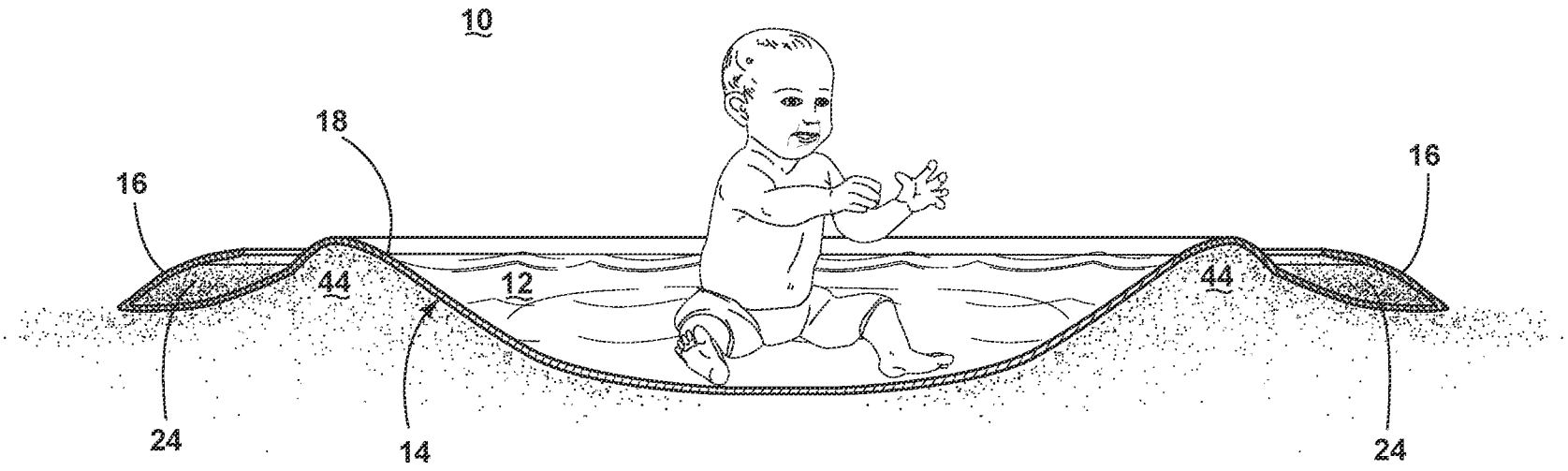
FIG. 2 is a cutaway perspective view of an embodiment of the foldable children's wading pool of FIG. 1, in use, and along the sectional line marked as II.
Figure 3:
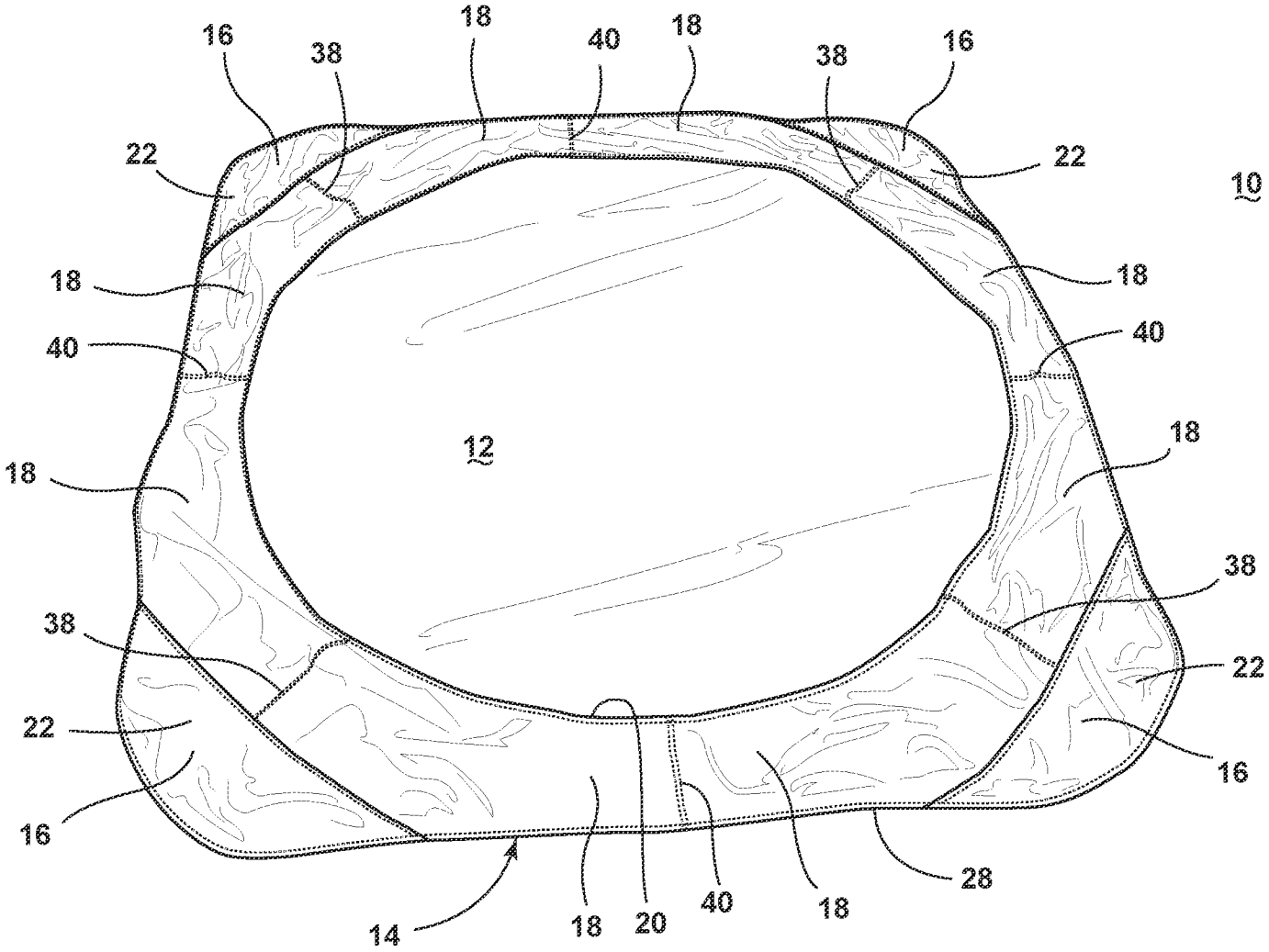
FIG. 3 is a top perspective view of an embodiment of the foldable children's wading pool, laid flat and not in use.

One embodiment of a portable children's wading pool 10 is illustrated in FIGS. 1-3. The pool 10 includes a woven fabric base section 12, a stabilizer section 14, and four sand anchors 16. The woven fabric base section 12 is at least "water-resistant" and is preferably "water-proof". The base section 12 is preferably a single, circular shaped sheet of fabric. The fabric base section 12 can be comprised of any suitable water-resistant or water-proof material, such as, but not limited to polyester canvas with polyurethane coating, plasticized polyvinyl chloride (PVC) and/or low-density polyethylene (LDPE), so long as it conforms to the thickness parameters discussed further below. Preferably, the fabric base section 12 is comprised of a waterproof fabric material that is durable when repeatedly exposed to water, salt water, sand and sun. Further preferably, the fabric base section 12 is a different color than the fabric stabilizer section 14, to create visually distinct areas for water (the base section 12) and support of the pool (the stabilizer section 14), when the pool is filled with water. This color distinction assists parents with set-up of the pool, and assists children with ingress and egress.

In the embodiment of FIGS. 1-3, the stabilizer section 14 is a water-permeable woven fabric. Preferably, the water-permeable woven fabric is resistant to wear and is durable when exposed to water, salt water, sand and sun. The stabilizer section 14 has eight sub-sections 18, each of which is sewn, bonded, or otherwise attached to an adjacent subsection 18. The stabilizer section 14 is, in turn, sewed, bonded, or otherwise attached to an outer edge 20 of the base section 12. The base section 12 fabric is, in one embodiment, sewn to the stabilizer section 14 such that the outer edge of the base section 12 is under the inner edge of the stabilizer section 14, to reduce water leakage at this seam. The stabilizer section also includes a reinforced seam or edge 28 to assist with durability and directing the force vectors discussed below.

The pool 10 also includes four sand anchors 16. The sand anchors 16 may be formed by affixing a pocket top 22 to each of the four corners of the stabilizer section 14. Alternatively, the sand anchors 16 may be separately sewn pockets, which are then affixed to the stabilizer section 14. The sand anchors 16 are generally oriented as the four corners of a square, or put another way, they are radially offset from one another by approximately ninety degrees. Other numbers of sand anchors may be implemented, such as three sand anchors radially offset from one another at approximately one-hundred and twenty degrees; five sand anchors radially offset from one another at approximately seventy-two degrees; six sand anchors radially offset from one another at approximately sixty degrees, etc.

In a preferred embodiment, the base section 12 is generally circular. The round shape enables parents to set the pool limits very easily. Width and depth of the sand hole (and thus the amount of water that can be contained in the base section 12) are both important factors for parents to decide how to safely set up the pool for their infant or toddler, based on factors such as the child's age, coordination, strength and comfort with being in water. The round shape enables this, because it makes it easy for parents to set up the pool as a shallower pool, or a deeper pool, depending on how deeply they dig the hole.

The portable children's pool 10 is stabilized against being blown by the wind and against shifting sand caused by the entry and exist of children into the pool by the integrated action of the base section 12, and the weight of the water in the base section 12, which pulls against the stabilizer section 14 and the weight of the sand 24 (or other weighting material) in the sand anchors 16. In a preferred embodiment, the pool 10 is configured such that the weight of the water and the weight of the sand will create opposing forces, which are roughly balanced against one another, and which pull the stabilizer section 14 over and against the sand of the sand berms 44.

Figure 4:
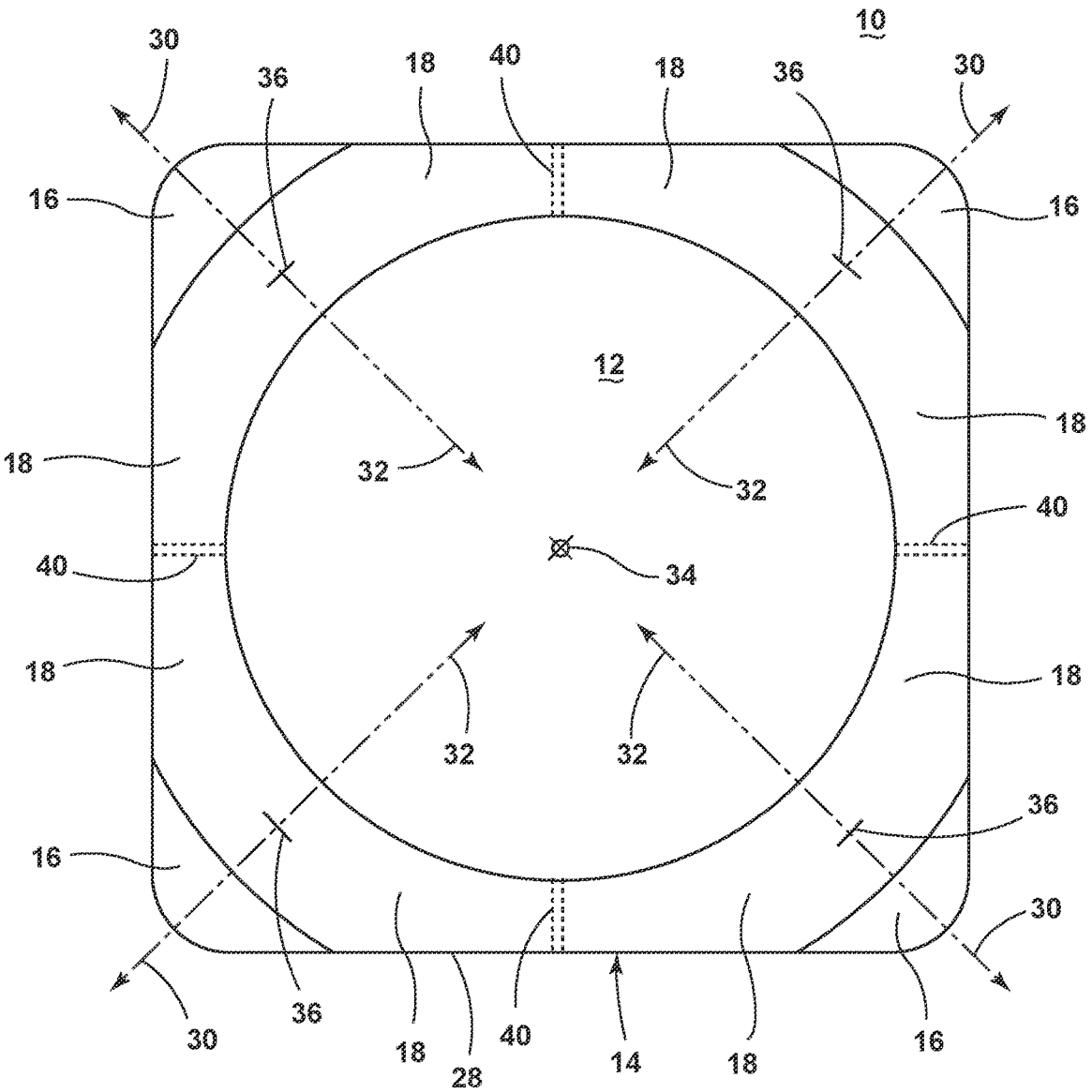
FIG. 4 is a schematic top view of an embodiment of the foldable children's wading pool, when in use and illustrating lines of force generated by the balanced weights of water and sand.

With reference to FIG. 4, a schematic top view of the pool 10, when in use, is shown. When the base section 12 is filled with water, and the sand anchors 16 are each filled with sand or other weighting material, and the stabilizer section 14 is in place over a sand berm, force vectors are created that stabilize the pool 10. Specifically, sand anchor weight force vectors 30 pull outwardly, while water weight force vectors 32 pull inwardly toward the center 34 of the base section 12. In a preferred deployment, the sand anchor weight force vectors and the water weight force vectors are roughly equal, and balance at balance points 36 within the stabilizer section 14. This balance serves to stabilize the pool 10 in the sand hole, to prevent the edges 28 of the stabilizer section 14 from blowing or flipping upward, while at the same time minimizing the time and complexity of the setup effort required of parents deploying the pool 10.

Figure 5:
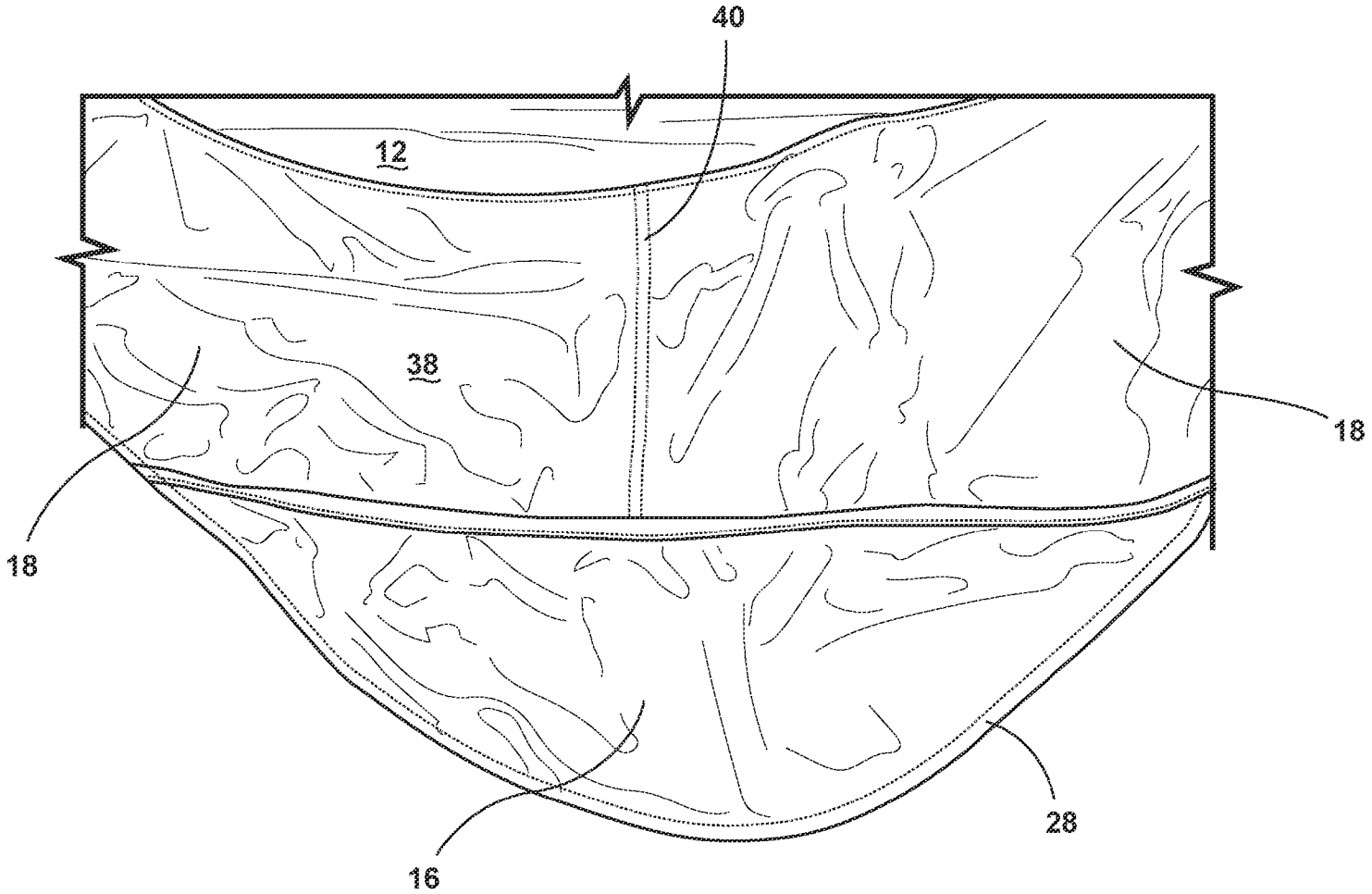
FIG. 5 is a close-up, cutaway, top perspective view of a corner sand anchor pocket of the foldable children's wading pool of FIG. 2, where the sand anchor pocket is laid flat.
Figure 6:
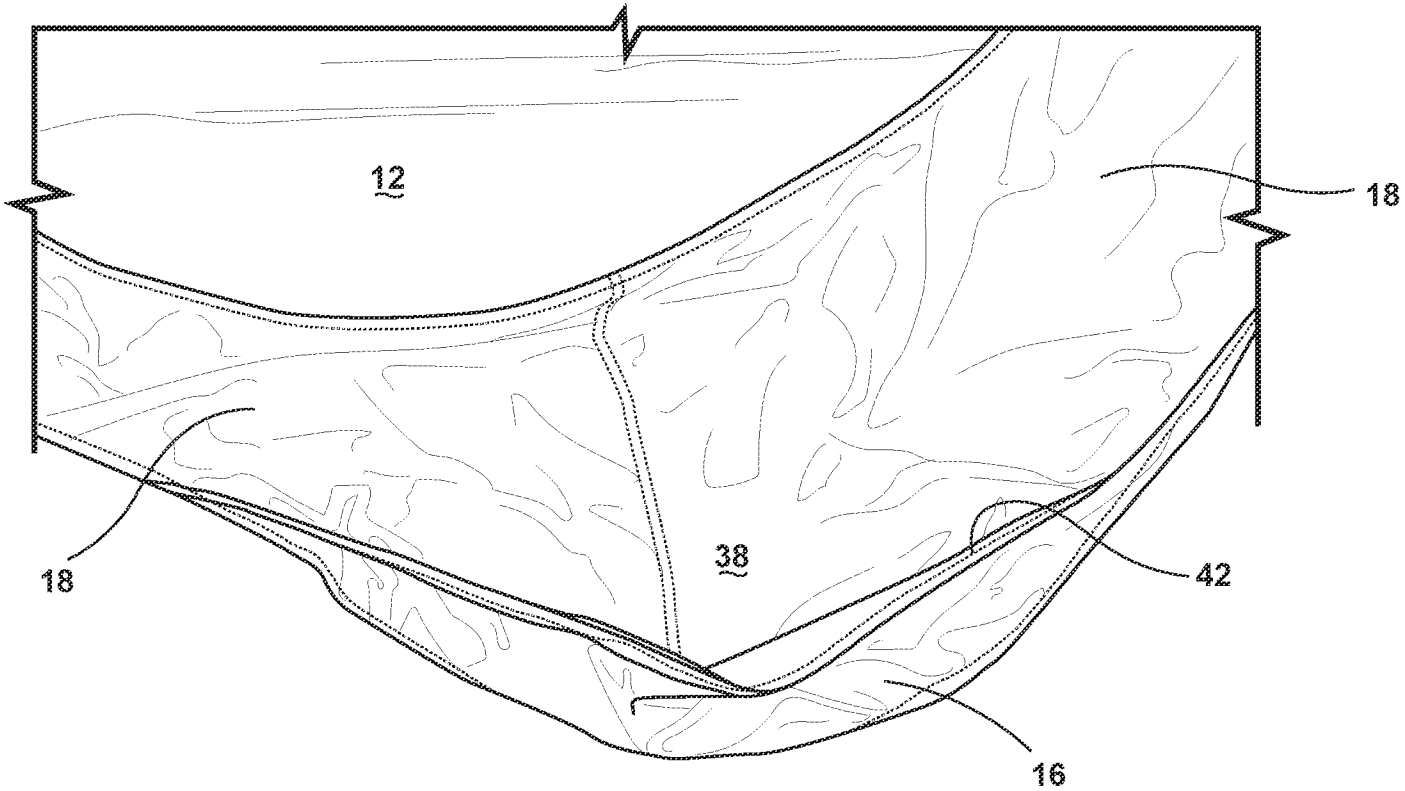
FIG. 6 is a close-up, cutaway, top perspective view of a corner sand anchor pocket of the foldable children's wading pool of FIG. 2, where the sand anchor pocket is pulled open in preparation for use.

With reference to FIGS. 5-6, further detail of the pockets forming the sand anchors 16 are illustrated. In FIG. 5, the sand anchor 16 pocket is generally flat. In FIG. 6, the sand anchor 16 pocket is opened and ready to receive sand or weighting material. In a preferred embodiment, a seam 38, between two sub-sections 18 of the stabilizer section 14, is generally centered on the outer flap 22 of the pocket forming the sand anchor 16. This seam 38 (on each of the four pockets) serves to direct and focus the opposing forces of the sand anchor weight force vectors 30 and the water weight force vectors 32. The outer flap 22 of the sand anchor 16 also includes a reinforcing seam 42 at the top edge of the pocket 22, which is stitched or bonded in connection with the outer reinforcing seam 28 of the stabilizer section 14. As explained throughout, this "web" of reinforcing seams serves to strengthen the fabric sections of the pool and further to direct the opposing forces of the sand anchor weight force vectors 30 and the water weight force vectors 32 throughout the entire pool 10, and accordingly to create a balance of forces that stabilize the sand sidewalls of the berm 44, stabilize the pool 10 in the sand, smooth the fabric of the base section 12 when filled with water, to make set-up easier, to make ingress and egress easier, and to improve the overall neat and tidy appearance of the pool 10 when deployed.

While not intended to be limiting in any way, one embodiment of the pool 10 has the following dimensions. The pool 10 is approximately ninety inches wide on the diagonal cross-section line II of FIG. 1. That particular embodiment has a circular base section that is approximately sixty inches in diameter. The stabilizer section is approximately seven inches wide at the sub-section seam 40, and approximately fifteen inches wide along seam 38, measured from the seam 20 joining the base section and stabilizer section, to the outer edge of the sand pocket16, along diagonal cross-section line II of FIG. 1. Further, in this embodiment, base section 12 the pool 10 can be filled with between approximately two to forty gallons of water, and each sand anchor can be filled with between approximately one to three gallons of sand or other weighting material. When filled with approximately thirty gallons of water, the base section 12 will contain a depth of between eighteen to twenty-four inches of water, as measured from the center point of the base section 12.

Denier (abbreviated D), a unit of measure for the linear mass density of fibers (sometimes referred to herein, for convenience, as "thickness"), is the mass in grams per 9000 meters of the fiber. The denier is based on a natural reference: a single strand of silk is approximately one denier; a 9000-meter strand of silk weighs about one gram. Nylon and polyester fabrics are typically measured in denier. While the disclosure herein addresses embodiments of the fabric wading pool that are made with nylon, polyester and/or polyester/nylon blends of disclosed denier ranges, it should be understood that other fabrics of similar weights and similar water resistance (or permeability) may be used in place of the specific fabric applications addressed herein, and such other fabrics meeting these specifications should be understood to constitute equivalents for purposes of the claims herein.

In certain embodiments, use of particular classes and types of fabric for each section are advantageous. In preferred embodiments, the base section 12 material must be thin enough to form properly to the sand. Proper form to the sand generally means that the base section 12 material does not have significant numbers of wrinkles when in the base section is filled with water. Addressing this problem was necessitated by parents who tested experimental versions of Applicant's pools that had overly thick base section material and who reported that the form of the pool "did not look or feel right" due to the wrinkles and the thickness of the base section material.

Properly thin base section material is also complimentary with the material that forms the sand anchors. In contrast, overly thick material for the base section 12 results in a base section that is too heavy to allow the weight of the sand in the sand anchors to pull the pool into its designed shape, as discussed with respect to FIG. 4.

Figure 7:
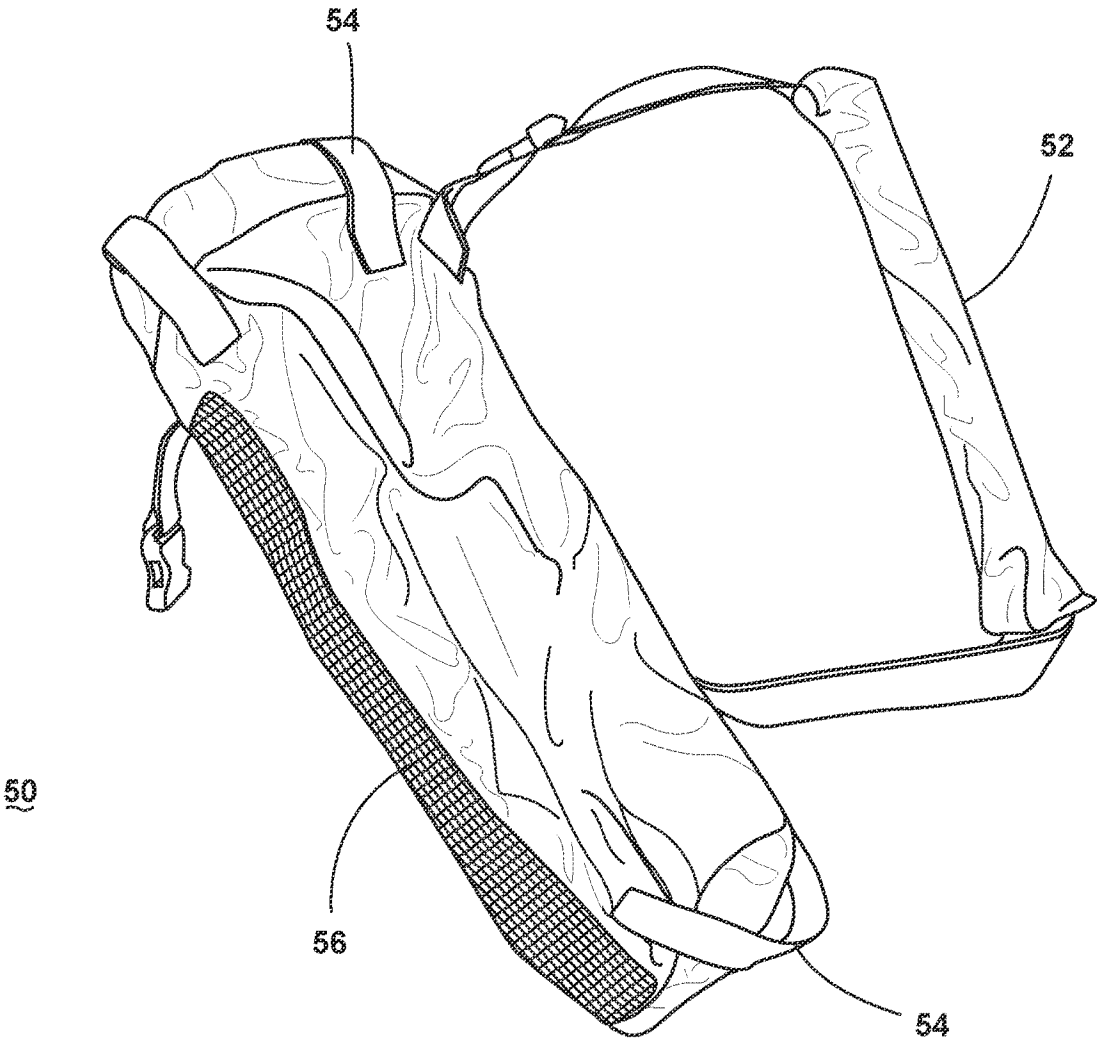
FIG. 7 is a side view of a waterproof bag into which the foldable children's wading pool of FIG. 1 can be folded for transport and storage.
Figure 8:
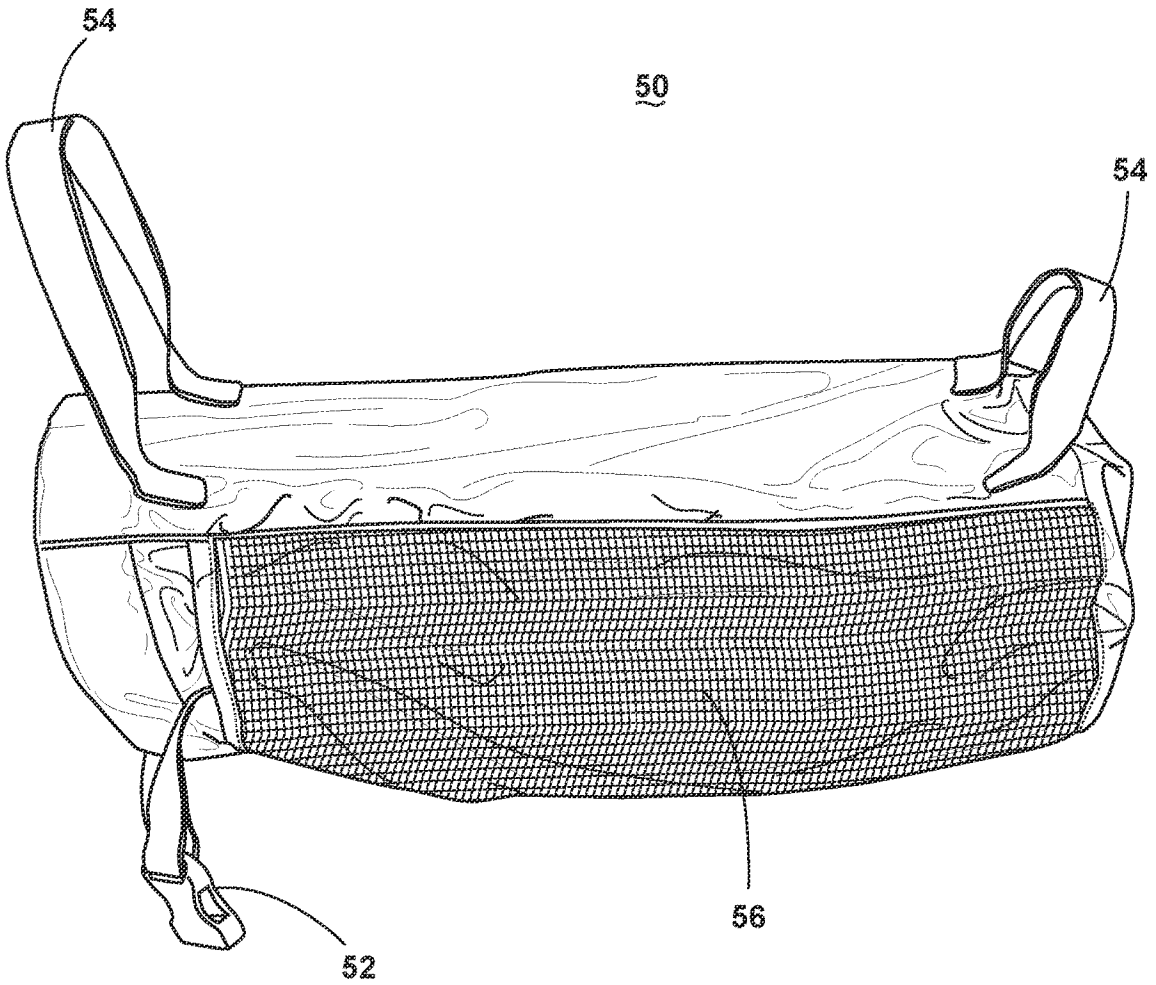
FIG. 8 is another side view of the waterproof bag of FIG. 6, with the top and bottom handle straps held outwardly, in preparation for use of the waterproof bag as a water carrying device.
Figure 9:
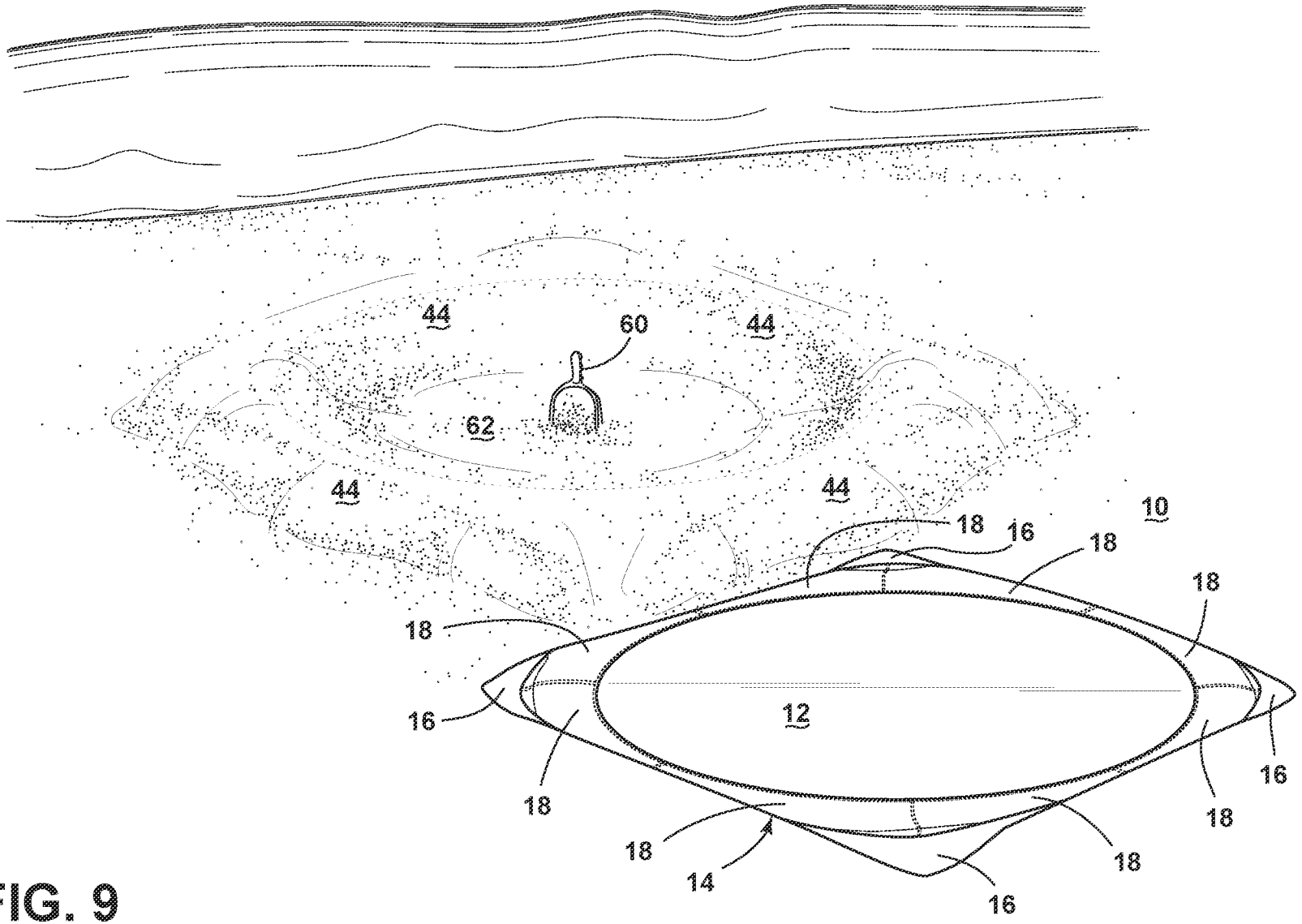
FIG. 9 is a perspective view of a step in the deployment of an embodiment of the wading pool disclosed herein.
Figure 10:
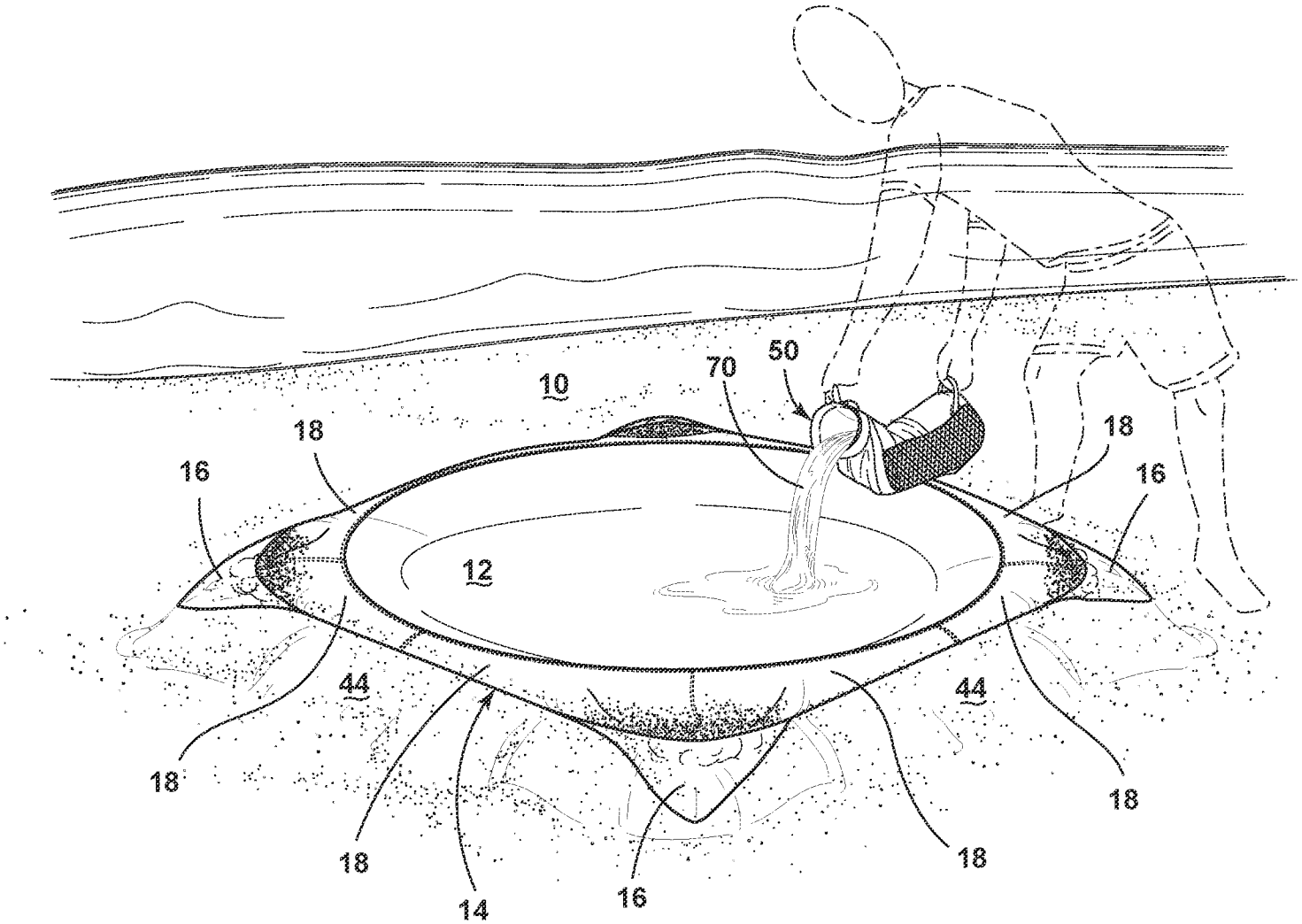
FIG. 10 is a perspective view of another step in the deployment of an embodiment of the wading pool disclosed herein.

Properly thin base section material is also able to bundle-up well for storage, and be inserted and stored in a back-pack/bucket (See FIGS. 7-8). In contrast, overly thick base section material is difficult to fold or roll for storage.

Moreover, properly thin base section fabric is also able to dry out quickly after use and either before or after the pool 10 is folded and stored. In contrast, overly thick base section material may trap water, or stay moist, and cause a potential for mold build-up or bacterial growth. Such mold or bacterial growth would make the pool unsightly, or even present a health danger to toddlers.

On the other hand, in preferred embodiments, the base section 12 material must also be thick enough to stabilize the pool 10 sides and bottom. In contrast, overly thin base section 12 fabric did not work well because when a child stepped into the experimental, but overly thin, base section fabric, that fabric compressed into the sand and displaced the pool limits.

Properly thick base section material is also complimentary with the material that forms the sand anchors. In contrast, overly thin material for the base section 12 results in a base section that is too light to pull against the weight of the sand in the sand anchors to pull the pool into its designed shape, as discussed with respect to FIG. 4.

In a preferred embodiment, the portable fabric wading pool 10 includes a base region comprising a generally circular sheet of woven fabric, where the woven fabric of the base region is a fabric with a thread denier of between 400 denier and 600 denier, and is water-resistant. Further, in a preferred embodiment, the woven fabric of the stabilizer region is a fabric with a thread denier of between 200 denier and 400 denier;

In a still further preferred embodiment, the woven water-resistant fabric of the base region comprises polyester, such as, for example, 500 denier canopy polyester. The woven water-resistant fabric may include a waterproof coating of polyurethane, for example, a coating known as "pigment urethane coating."

In a preferred embodiment, the stabilizer region fabric is water permeable, and is, for example, a 400×300 denier nylon/polyester blend. The water-permeability of the stabilizer region fabric serves to prevent over-filling of the pool, and helps the pool dry quickly prior to storage. The stabilize region fabric may also be a diamond-pattern ripstop fabric.

FIGS. 7-8 illustrates a bag 50 for use with the pool 10. The bag 50 preferably has an assortment of straps 52 and handles 54 for carrying the bag, as well as pouches 56 for carrying beach accessories. The bag is preferably large enough for the entire pool 10 to be folded and stored within the bag 50. Further, preferably, the bag 50 is made of a water-resistant materially, and most preferably, a waterproof material, so that it can be used as bucket for carrying water and filling the pool, as described further below.

In FIGS. 1 & 2, the portable children' pool 10 is shown in use at the beach. With reference to FIGS. 1-2 and 9-10, a method for deployment and use of the pool 10 is described as follows. Specifically, as discussed further below, the pool 10 is unfolded, in-place in a hole, side berms of sand are mounded up, sand or other weighting material is put into the sand pockets, and then the base section is filled with water, using the bag. First, a digging tool 60, or even a user's hands, are used to outline a hole 62 in the sand that is roughly circular and the same size as the pool 10. The user then digs the hole 62, which should taper downward and inwardly from the edges of the hole. The user also should form sand berms 44 along the edges of the hole. These sand berms 44 should be taller than the surface of the surrounding ground and generally an extension of the side walls of the hole 62. Alternatively, the user may form the sand berms 44 after the pool 10 is laid in place in the hole 62. The user then unfolds the pool 10 and inserts it into the hole 62. The pool 10 should be oriented so that the base section 12 is in the hole 62. The pool 10 should be further oriented so that the stabilizer section 14 of the pool 10 is placed over the top 68 of each of the sand berms 44. Then, the sand anchors 16 should extend outwardly and down the outside sides of the sand berms 44. This configuration will enable the filled sand anchors 16 and the water 70 in the filled pool 10 to effect the force vector balance discussed herein and illustrated in FIG. 4.

On completion of the setup, the pool is configured as shown in FIG. 1 and a child may begin playing.

When the user is ready to take the pool down, this process can be reversed. Preferably, the weighting material can be dumped or scooped out of the sand anchor pockets 16. Then, any water 70 which has not been dipped out with the bag 50 can be simply dumped out into the hole when the pool 10 is lifted. Finally, the pool 10 is folded, then stored in the waterproof fabric bag 50.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

I claim:

1. A portable fabric wading pool comprising:

a base comprising water-resistant woven fabric of between 400 denier and 600 denier;

a stabilizer comprising woven fabric of between 200 denier and 400 denier; and wherein the stabilizer is affixed to an edge of the base.

2. The wading pool of claim 1, wherein the stabilizer further comprises a plurality of sand anchors.

3. The portable fabric wading pool of claim 2 wherein each of the plurality of sand anchors comprise a pocket.

4. The wading pool of claim 1 wherein the base further comprises a water-resistant coating.

5. The wading pool of claim 4 wherein the water resistant coating is selected from the group consisting of: polyurethane and pigment urethane.

6. The wading pool of claim 1 further comprising a separate fabric bag, into which a user can fold and store the entire wading pool.

7. The wading pool of claim 6 wherein the separate fabric bag is waterproof.

8. The portable fabric wading pool of claim 1 wherein the base and the stabilizer are different colors.

9. A method of making a portable fabric wading pool comprising:

selecting a first water-resistant woven fabric of between 400 denier and 600 denier;

selecting a second woven fabric of between 200 denier and 400 denier;

cutting a pool base from the first water-resistant woven fabric;

cutting a stabilizer from the second woven fabric;

affixing the stabilizer to an edge of the pool base; and forming a sand anchor pocket on the stabilizer.

10. The method of claim 6 wherein the pool base further comprises a water-resistant coating.

11. The method of claim 6 wherein the pool base and the stabilizer are different colors.

12. The method of claim 9 wherein the pool base further comprises a water-resistant coating.

13. The method of claim 12 wherein the water resistant coating is selected from the group consisting of: polyurethane and pigment urethane.

14. The method of claim 9 further comprising:

constructing a separate fabric bag, into which a user can fold and store the entire wading pool.

15. The method of claim 14 wherein the separate fabric bag is waterproof.

16. A method of using a portable fabric wading pool, wherein the portable fabric wading pool comprises:

a base comprising a water-resistant woven fabric of between 400 denier and 600 denier;

a stabilizer comprising a woven fabric of between 200 and 400 denier;

wherein the stabilizer is affixed to an edge of the base; and wherein the stabilizer further comprises a plurality of sand anchors;

wherein the method of using comprises:

digging a hole in a sandy surface, wherein the hole is approximately the same circumference as the base;

forming sand berms generally along the edge of the hole;

placing the portable fabric wading pool in the hole, wherein the base is generally centered in the hole;

placing the stabilizer generally over the sand berms;

placing a quantity of weighting material in the plurality of sand anchors; and placing water in the base.

17. The method of claim 16, wherein the wading pool further comprises a separate waterproof fabric bag, and the step of placing water in the base further comprises using the waterproof fabric bag to transport water from a water source to the wading pool.

* * * * *